United States Patent [19]

Zelahy

[11] 4,214,355

[45] Jul. 29, 1980

[54] METHOD FOR REPAIRING A TURBOMACHINERY BLADE TIP

[75] Inventor: John W. Zelahy, West Chester, Ohio

[73] Assignee: General Electric Company, Cincinnati, Ohio

[21] Appl. No.: 862,781

[22] Filed: Dec. 21, 1977

[51] Int. Cl.[2] ..... B23P 15/04; B23P 7/00

[52] U.S. Cl. ..... 29/156.8 B; 29/156.8 H; 29/402.13; 228/182; 228/193; 416/213 R; 416/232

[58] Field of Search ..... 416/92, 213 R, 228, 416/232; 415/172 A; 29/156.8 H, 156.8 B, 156.8 R, 401 C, 401 D, 401 R; 228/182, 193, 194, 195, 119

[56] References Cited

U.S. PATENT DOCUMENTS

| | | | |
|---|---|---|---|
| 1,998,398 | 4/1935 | Junggren | 29/156.8 B |
| 3,389,889 | 6/1968 | Penny | 416/92 |
| 3,533,712 | 10/1970 | Kercher | 416/92 |
| 3,574,924 | 4/1971 | Dibble | 228/119 |
| 3,615,376 | 10/1971 | Ross | 148/162 |
| 3,626,568 | 12/1971 | Silverstein et al. | 29/156.8 H |
| 3,650,635 | 3/1972 | Wachtell et al. | 29/156.8 B |
| 3,700,427 | 10/1972 | Hoppin et al. | 75/171 |
| 3,759,692 | 9/1973 | Zelahy | 75/171 |
| 3,761,201 | 9/1973 | Silverstein et al. | 416/232 |
| 3,854,842 | 12/1974 | Caudill | 415/174 |
| 3,876,330 | 4/1975 | Pearson et al. | 416/92 |
| 3,899,267 | 8/1975 | Dennis et al. | 416/92 |

FOREIGN PATENT DOCUMENTS

| | | | |
|---|---|---|---|
| 207859 | 3/1960 | Austria | 416/228 |
| 1087745 | 8/1960 | Fed. Rep. of Germany | 416/228 |
| 1239525 | 4/1967 | Fed. Rep. of Germany | 416/228 |
| 1428165 | 2/1969 | Fed. Rep. of Germany | 416/228 |
| 572059 | 9/1945 | United Kingdom | 416/228 |
| 1276200 | 6/1972 | United Kingdom | 416/92 |

*Primary Examiner*—Daniel C. Crane
*Attorney, Agent, or Firm*—Lee H. Sachs; Derek P. Lawrence

[57] ABSTRACT

A turbomachinery blade including a hollow interior is provided with an improved tip cap comprising first and second members each made of an alloy of a composition and properties different from the other. The first member, in the form of a closure plate bonded to sidewalls of the hollow body, is of a nickel-base or cobalt-base superalloy casting characterized by high mechanical strength properties at elevated temperatures. The second member is a rib of the shape of and bonded to the first member and is of a cast alloy characterized by the combination of resistance to oxidation, sulfidation and thermal fatigue at elevated temperatures. The second member provides an outer tip extension of the blade.

3 Claims, 3 Drawing Figures

METHOD FOR REPAIRING A TURBOMACHINERY BLADE TIP

CROSS REFERENCE TO RELATED APPLICATIONS

This application relates to copending and concurrently filed applications Ser. No. 862,782, entitled "Improved Casting Alloy and Directionally Solidified Article"; and Ser. No. 863,017, entitled "Improved Gas Seal and Method for Making".

BACKGROUND OF THE INVENTION

This invention relates to turbomachinery blades and, more particularly, to an improved tip cap configuration for such a blade.

It is well known that gas turbine engine efficiency is, at least in part, dependent upon the extent to which compressed air in the compressor or expanding combustion products in the turbine leak across a gap between blading members and opposing surfaces, such as shrouds. In the hotter turbine section, the problem of interference between such cooperating members is more critical because of greater differences in their thermal expansion or contraction characteristics. Therefore, a variety of configurations for tip caps for the type of hollow turbine blades used in modern gas turbine engines has been reported. Typical of such configurations are those described in U.S. Pat. Nos. 3,854,842; 3,899,267 and 4,010,531, issued Dec. 17, 1974, Aug. 12, 1975 and Mar. 8, 1977, respectively. The disclosure of each of such patents is incorporated herein by reference.

During operation of a gas turbine engine, interference between such relatively rotating blade tips and opposing surfaces, due to differences in coefficients of thermal expansion, has resulted in worn or damaged blade tips. Because of the complexity and relative high cost of such a component, it is desirable to repair rather than to replace such an article.

SUMMARY OF THE INVENTION

It is a principal object of the present invention to provide an improved turbomachinery blade tip cap which provides high strength closure to an internal cavity of a hollow blading member and, in addition, provides a combination of oxidation, corrosion and thermal fatigue resistance at the blade interface with a cooperating member.

Another object is to provide such a tip cap which is easily repairable after operation of a blading member in a gas turbine engine.

Still another object is to provide an improved method for repairing a turbomachinery blade having a damaged tip cap.

These and other objects and advantages will be more fully understood from the following detailed description, the drawing and the examples, all of which are intended to be representative of rather than limiting in any way on the scope of the present invention.

Briefly, the present invention provides a turbomachinery blade which includes an airfoil-shaped hollow body, having sidewalls defining one portion of an internal cavity, and an airfoil-shaped tip cap defining the radial outer boundary of the internal cavity. According to the present invention, the improved tip cap comprises first and second members which are discrete or separately produced, each made of an alloy of composition and properties different from the other. The first member is an airfoil-shaped closure plate for providing at least partial closure of the internal cavity, is of a cast alloy selected from nickel-base and cobalt-base superalloys and is characterized by high mechanical strength properties at elevated temperatures. The first member is bonded to the sidewalls of the hollow body. The second member is a rib substantially of the airfoil shape of the first member and is of a cast alloy characterized by resistance to oxidation, sulfidation and thermal fatigue at elevated temperatures. The second member is bonded to the first member, thus providing an outer tip extension of the blade.

In the method associated with the present invention for repairing a hollow turbomachinery blade with a damaged tip cap, such tip cap is removed from the sidewalls of the hollow body. Then an airfoil-shaped closure plate of the type described above is diffusion bonded to the sidewalls after which a rib of the type described above is diffusion bonded to the periphery of the closure plate. Thus, an improved tip cap replaces the damaged one, obviating scrapping of the entire blade because of tip cap damage.

DESCRIPTION OF THE PREFERRED EMBODIMENT

Figure 1:
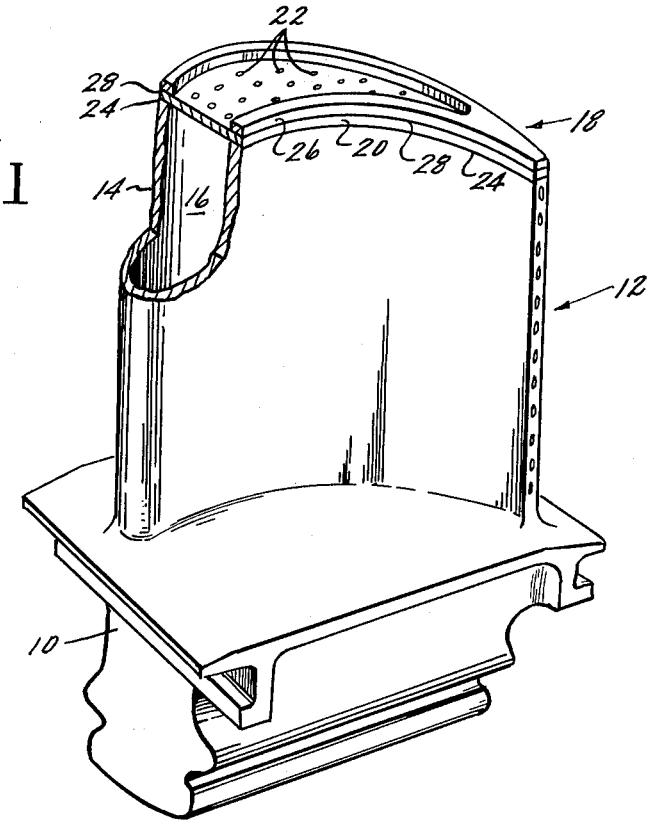
FIG. 1 is a perspective, partially sectional view of a turbomachinery blade in accordance with a preferred embodiment of the present invention.
Figure 2:
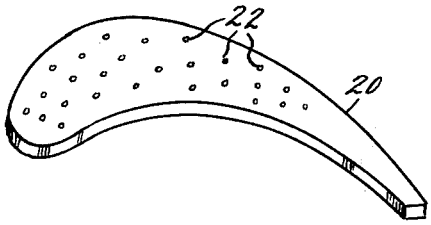
FIG. 2 is a perspective view of the closure plate in the tip cap of the blade of FIG. 1.

Referring to the drawings wherein like numerals correspond to like elements, FIG. 1 shows a turbomachinery blade including a base 10 and an airfoil shown generally at 12. Airfoil 12 includes airfoil-shaped sidewall 14 partially defining airfoil shaped internal cavity 16. The radially outward portion of interior cavity 16 is defined by airfoil-shaped tip cap shown generally at 18. Such tip cap includes an inner or first member 20 in the form of an airfoil-shaped closure plate for providing at least partial closure of the internal cavity, egress from such cavity, for example for cooling fluid, being through openings 22. Closure plate 20, shown in more detail in FIG. 2, is secured with sidewall 14 such as through a diffusion bond 24. Radially outward from and bonded to the first member 20 is a second member 26 in the form of a substantially continuous, airfoil-shaped rib, substantially of the airfoil shape of the first member. As shown in more detail in FIG. 3, such rib, shown to define a closed airfoil shape, provides the outer tip extension of the blade airfoil 12. The second member is bonded, such as through a diffusion bond, to the first member at joint 28.

According to the present invention, the alloy composition and properties of first member 20 are different from the alloy composition and properties of second member 26. The alloy of first member 20 is typical of and can be identical to a variety of high temperature cast Ni-base or Co-base superalloys used in the manufacture of gas turbine engine turbine blades and characterized by high mechanical strength properties at elevated temperatures. For example, in one embodiment of the present invention, sidewall 14 and closure plate 20 were both of a material sometimes referred to as Rene' 80 alloy, more fully described in U.S. Pat. No. 3,615,376 and consisting nominally, by weight, of 0.17% C, 14% Cr, 5% Ti, 0.015% B, 3% Al, 4% W, 4% Mo, 9.5% Co, 0.05% Zr, with the balance Ni and incidental impurities. First member 20 was diffusion bonded to sidewalls 14 at joint or bond 24 by a diffusion bonding method described in U.S. Pat. No. 3,632,319, issued Jan. 4, 1972, using such bonding materials as are described in U.S. Pat. Nos. 3,700,427 and 3,759,692, issued Oct. 24, 1972 and Sept. 18, 1973, respectively. The disclosure of each of these above-mentioned four patents is incorporated herein by reference. It should be understood, however, that a variety of bonding methods can be used, although diffusion bonding across relatively narrow tolerances as preferred.

The alloy of second member 26, in contrast to the alloy of first member 20, is characterized by the combination of resistance to oxidation, sulfidation and thermal fatigue at elevated temperatures. In the above-mentioned example, the alloy of rib 26 was a cobalt-base alloy, sometimes referred to as HS188 alloy and having a nominal composition, by weight, of 22% Cr, 22% Ni, 14.5% W, 0.1% C, 0.1% La with the balance essentially Co and incidental impurities, in wrought form. However, it has been recognized that rib 26 in the form of a cast, directionally oriented microstructure article, preferably a single crystal, is particularly advantageous in advanced gas turbine engines for thermal fatigue improvement. Thus, the intended application will determine the particular material and structure to be used as rib 26, provided it has the characteristics of resistance to oxidation, sulfidation and thermal fatigue at elevated temperatures and compatibility with closure plate or first member 20. For example, a Ni-Co-Cr-base alloy, more particularly described in the above cross-referenced application entitled, "Improved Casting Alloy and Directionally Solidified Article," can be particularly advantageous for use in advanced gas turbine engines. As was mentioned above, such first member can be selected from a variety of commonly used nickel-base or cobalt-base superalloys in cast form, provided they are characterized by high mechanical strength properties at elevated temperatures.

Figure 3:
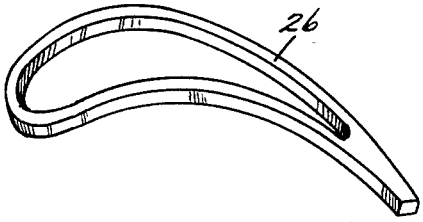
FIG. 3 is a perspective view of the airfoil-shaped rib which provides the outer tip extension of the blade in FIG. 1.

Associated with the present invention is an improved method for repairing a turbomachinery blade having an airfoil-shaped hollow body defined, in part, by sidewalls with which a damaged tip cap is connected. The present invention enables replacement of such tip cap with an improved tip cap, thus obviating scrapping of the entire blade. According to such method, the damaged tip cap, such as 18 in FIG. 1, is removed from the blade body such as at sidewall 14. Such damaged tip cap can be in a variety of configurations, for example as described in the above-incorporated patent disclosures. A part of sidewall may be removed as well. Then an airfoil-shaped closure plate, such as 20 in FIG. 2, of a high strength nickel-base or cobalt-base superalloy depending on the intended application or material of the sidewalls, is diffusion bonded to sidewall 14. Thereafter, a rib, such as 26 in FIG. 3, is provided substantially to the airfoil shape of the closure plate and is diffusion bonded to the periphery of the closure plate as shown in FIG. 1. The alloy from which the rib is made is characterized by resistance to oxidation, sulfidation and thermal fatigue at elevated temperatures. As described above, it is particularly advantageous as a casting having a directionally oriented structure, preferably a single crystal.

Although the present invention has been described in connection with specific examples, it will be recognized by those skilled in the art that a variety of modifications can be made of the present invention within the scope of the appended claims.

I claim:

1. In a method for repairing a turbomachinery blade which includes an airfoil-shaped hollow body having sidewalls defining one portion of an internal cavity and an airfoil-shaped tip cap defining the radially outer boundary of said internal cavity, the steps of:

removing the tip cap from the blade body;

providing an airfoil-shaped closure plate of a first alloy selected from the group consisting of nickel-base and cobalt-base superalloys, and characterized by high mechanical strength properties at elevated temperatures;

diffusion bonding the closure plate to the sidewalls;

providing a rib member substantially of the airfoil shape of the closure plate and of a second alloy of composition different from that of the first alloy and characterized by resistance to oxidation, sulfidation and thermal fatigue at elevated temperatures; and then, diffusion bonding the rib member to the periphery of the closure plate.

2. The method of claim 1 in which the rib member is a casting having a directionally oriented structure.

3. The method of claim 2 in which the rib member is a single crystal casting.

* * * * *